US006009579A

United States Patent [19]

Pedersen

[11] Patent Number: 6,009,579

[45] Date of Patent: Jan. 4, 2000

[54] FILLED TOPPER AND FEATHERBED COMBINATION

[75] Inventor: Samuel B. Pedersen, Seattle, Wash.

[73] Assignee: Pacific Coast Feather Company, Seattle, Wash.

[21] Appl. No.: 08/919,495

[22] Filed: Aug. 28, 1997

Related U.S. Application Data

[63] Continuation of application No. 08/919,495, Aug. 28, 1997.

[51] Int. Cl.[7] ..... A47C 27/00

[52] U.S. Cl. ..... 5/690; 5/691; 5/482; 5/499

[58] Field of Search ..... 5/690, 691, 692, 5/696, 737, 738, 482, 495, 496, 498, 499, 500, 501, 502, 922, 923

[56] References Cited

U.S. PATENT DOCUMENTS

| | | | |
|---|---|---|---|
| D. 267,696 | 1/1983 | Adams | 5/498 X |
| 1,261,314 | 4/1918 | Stoddard | 5/501 |
| 1,457,203 | 5/1923 | Wick | 5/733 X |
| 1,844,291 | 2/1932 | Markutsis | 5/501 |
| 1,928,943 | 10/1933 | McKay | 5/499 X |
| 2,179,175 | 11/1939 | Cohen, Jr. | 5/499 |
| 2,183,360 | 12/1939 | Sussman | 5/501 |
| 2,331,142 | 10/1943 | Seluk | 5/696 |
| 2,821,723 | 2/1958 | Gluck | 5/501 |
| 2,982,976 | 5/1961 | Ferolito | 5/499 |
| 3,286,284 | 11/1966 | Klogether et al. | 5/500 |
| 4,015,299 | 4/1977 | Tinnel | 5/496 X |
| 4,040,133 | 8/1977 | Gilreath | 5/923 X |
| 4,488,323 | 12/1984 | Colburn | 5/692 |
| 4,646,375 | 3/1987 | Parker | 5/923 X |
| 4,899,407 | 2/1990 | McCue | 5/923 X |
| 4,916,766 | 4/1990 | Grandy | 5/496 |
| 4,962,554 | 10/1990 | Tesch | 5/502 |
| 4,979,251 | 12/1990 | Lazar | 5/692 X |
| 5,428,852 | 7/1995 | Tenuta et al. | 5/690 |
| 5,441,789 | 8/1995 | Walker | 5/923 X |
| 5,732,424 | 3/1998 | Bond | 5/502 |
| 5,860,174 | 1/1999 | Failor | 5/922 X |

FOREIGN PATENT DOCUMENTS

| | | | |
|---|---|---|---|
| 14908 | 10/1898 | United Kingdom | 5/498 |

*Primary Examiner*—Terry Lee Melius
*Assistant Examiner*—Robert G. Santos
*Attorney, Agent, or Firm*—Jensen & Puntigam, P.S.

[57] ABSTRACT

The combination includes a featherbed and a relatively thin, down-filled top member which has a peripheral outline substantially identical to that of the featherbed. The top member is positioned on the upper surface of the featherbed. Attachment elements such as straps, ties and/or buttons or even a cover member are used to removably secure the top member in place on the upper surface of the featherbed and to prevent the top member from shifting position on the featherbed during use thereof.

7 Claims, 2 Drawing Sheets

FIG. 1
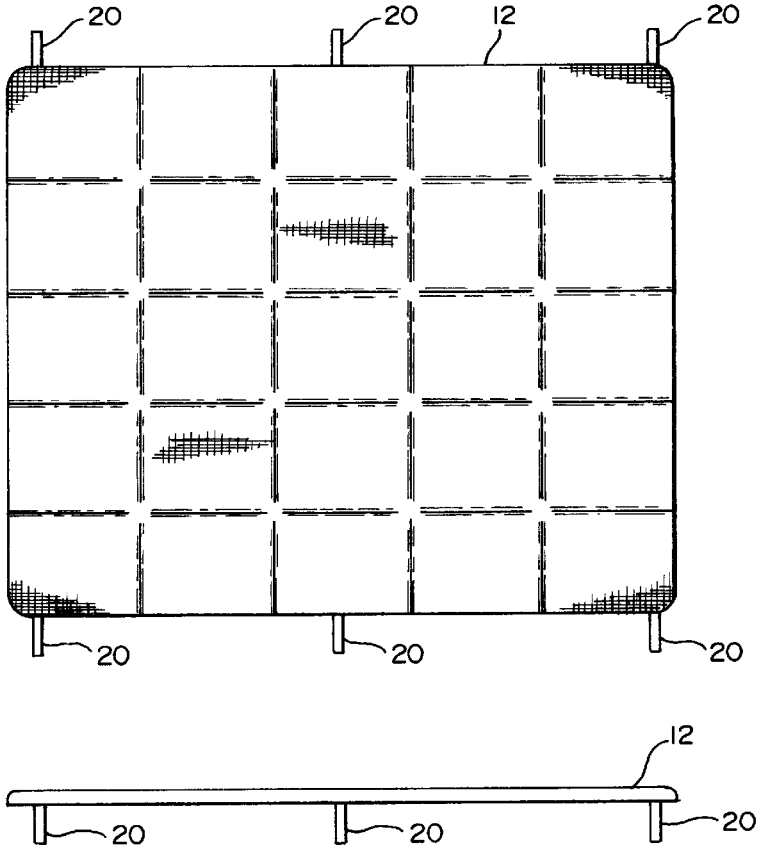
FIG. 2
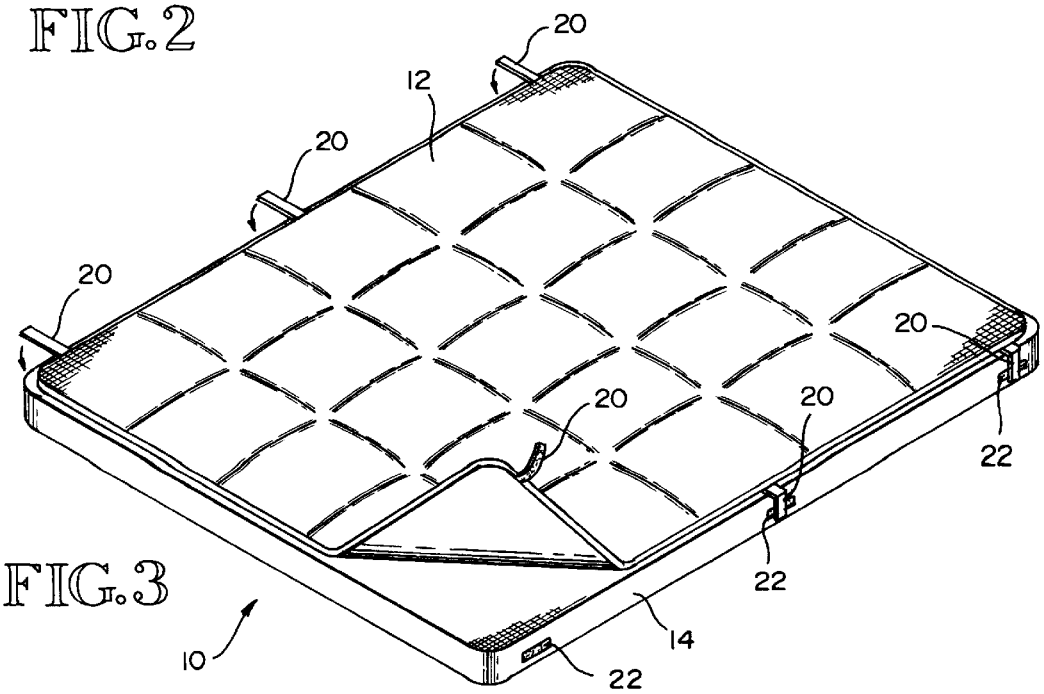
FIG. 3

FILLED TOPPER AND FEATHERBED COMBINATION

This is a continuation of application Ser. No. 08/919,495 filed on Aug. 28, 1997.

TECHNICAL FIELD

This invention relates generally to featherbeds, and more particularly concerns a combination of a featherbed and a filled top member positioned on the upper surface of the featherbed.

BACKGROUND OF THE INVENTION

The traditional featherbed has long been popular because of the sleeping comfort it provides. A typical featherbed is approximately six inches thick, and covers the top surface of the mattress. In use, a featherbed can be positioned on top of the lower sheet so that the user lies directly on the featherbed, or it can be positioned beneath the lower sheet. A conventional featherbed is filled with feathers and has a fill weight in the range of 5–17 pounds.

One significant disadvantage of featherbeds, however, is that they do get soiled, and they usually must be professionally dry cleaned. This is expensive and time-consuming. Attempts to conventionally wash a featherbed are typically not successful, due to capacity limitations of home laundering equipment. One attempted solution to the cleaning difficulty is to enclose the featherbed in a washable cover. However, use of a cover has not proven to be a satisfactory solution, as the featherbed is cumbersome and difficult to remove from and then re-insert into the cover. Further, the featherbed becomes difficult to fluff with a cover.

These disadvantages, particularly the difficulty and expense of regular cleaning of the featherbed and/or their covers, will tend to limit growth in sales of featherbeds in recent years.

DISCLOSURE OF THE INVENTION

Accordingly, the present invention is a featherbed and topper combination, which comprises: a featherbed member; a thin, lightly-filled top member having an outline substantially identical to the outline of the featherbed, wherein the top member is readily washable; and means for removably securing the top member to the featherbed.

BRIEF DESCRIPTION OF THE DRAWINGS

FIG. 1 is a top view of a topper portion of the combination of the present invention.

FIG. 2 is a side elevation view of the topper member of FIG. 1.

FIG. 3 is a schematic view of the combination of a topper member and a featherbed, secured together.

BEST MODE FOR CARRYING OUT THE INVENTION

Figure 4:
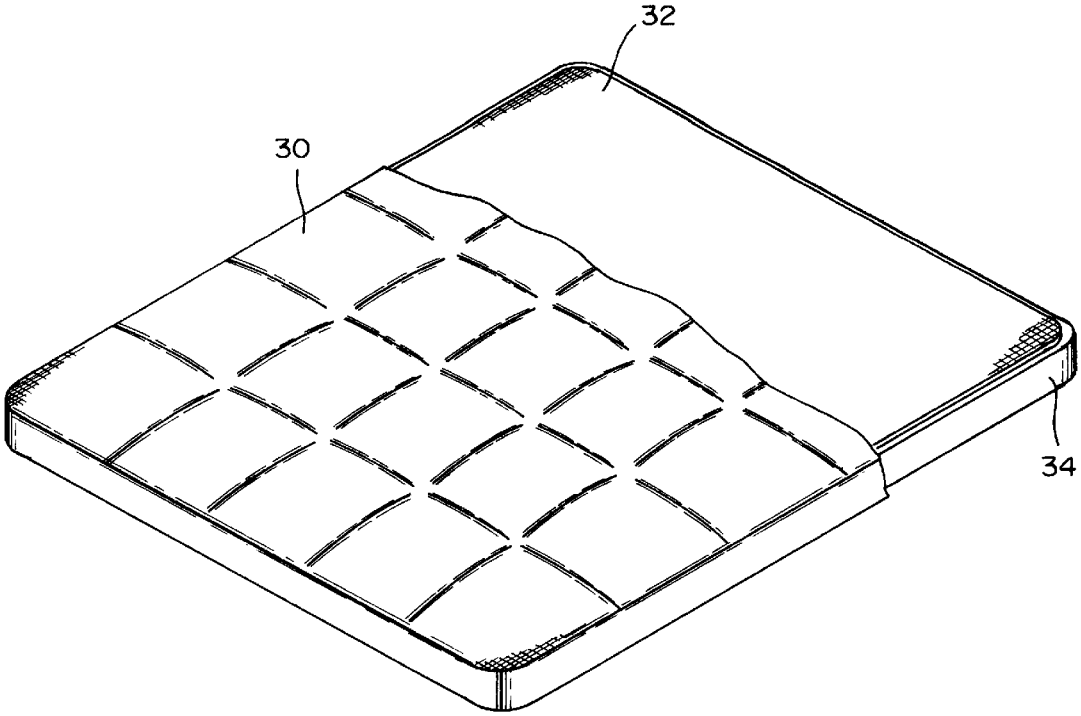
FIG. 4 is a schematic view of the combination of a topper member and a featherbed, secured together by a cover.

A standard featherbed 10, in combination with a down-filled top member 12, is shown in FIG. 3. The featherbed 10 in the embodiment shown can be configured to be used with any bed size, including individual/twin, queen, king and other sizes. In the embodiment shown, the featherbed 10 will typically be about six inches thick, although this can be varied. Further, featherbed 10 can be stitched so as to maintain the filling evenly through the unit, without an accumulation thereof in a particular area. The tick portion 14 of the featherbed is fabric, usually 100 per cent cotton, which is sufficiently dense (high enough stitch count) to generally prevent the movement of feathers migrating through the tick.

The interior of the featherbed has a fill weight of approximately 5–17 pounds. The weight of the filling, as well as the filling itself, can be varied within conventional featherbed standards. The featherbed 10 could be filled with feathers or synthetic material. It should be emphasized that the featherbed portion of the combination can be either strictly conventional or itself incorporate some novel features.

As indicated above, conventional featherbeds are difficult/expensive to clean. Furthermore, it is not uncommon that some feathers may migrate out of the featherbed, causing discomfort to the users.

Positioned on top of the featherbed 10 is the top member 12, also known as a topper, shown by itself in FIGS. 1 and 2 and on a featherbed in FIG. 3. The topper has a peripheral configuration which is similar, if not substantially identical, to that of the featherbed, as the exterior outline or periphery of topper 12 is intended to basically match the outline of the featherbed with which it is used. The topper element 12 typically will come in a variety of sizes to match the variety of sizes for a featherbed, including, for instance, conventional twin size, full size, queen and king.

The tick portion of topper 12 will typically be made of 100 per cent cotton material, similar to the fabric used for the ticks of traditional down comforters. One of the advantages to the use of such material is that the resulting tick does not permit the down material to migrate through the tick. In the embodiment shown, the topper is quite thin, approximately 1–4 inches thick, with the topper having a fill weight which is less than for the lightest down comforter. For instance, a twin size topper will have 6–16 (11–13 preferred) ounces of down fill, while a queen size will have 10–24 (17–20 preferred) ounces of down fill. The filling, while preferably of natural down, can also be artificial down, as well as other equivalent material, such as feathers or synthetic material. The fill weight for synthetic material will be slightly greater than for down. The down-topper is typically stitched in such a way as to maintain an even distribution of down, such as with the crossing pattern of FIG. 1.

As indicated above, the top member 12 rests on top of the conventional featherbed with which it is used. It is important that the down-topper stay in place during use. A number of different ways can be used to accomplish this result. For instance, Velcro straps shown at 20 in FIG. 1 can be secured at various points around the periphery of the topper, including for instance the corners and/or points midway between the corners, particularly on the sides, such as shown in FIGS. 1 and 2. The Velcro straps can then mate with matching Velcro portions 22 sewn or otherwise attached to the featherbed. Alternative securing elements, including string ties at specific locations, buttons, zippers or other means, can be used to provide the required attachment. Another alternative attachment is a loop strap at each corner which will be positioned under the corner of the mattress, keeping the topper and the featherbed together on the mattress.

Another important aspect of the arrangement is that the attachment must be conveniently removable, i.e. that the attachment elements on the respective featherbed and topper can be readily separated, permitting the topper to be removed easily from its associated featherbed. This is important because the topper, being thin, lightweight, easy to handle, with a washable tick, is readily and repeatedly washable in a conventional home washing machine. Permanent securement of the down-topper to the featherbed would not result in that advantage.

An alternative means of securing the topper to the featherbed is shown in FIG. 4. It comprises a cover 30 which fits over the combination of a topper 32 and a featherbed 34. While perhaps not as effective or as convenient as Velcro straps or ties, it does provide a means for producing the required secure positioning of the two members so that the top member 32 does not become misadjusted relative to the featherbed 34 during use. The cover itself can have buttons, zipper or Velcro fasteners which would permit the cover to be readily opened.

In use, the secured combination of the topper 12 and the featherbed 14 is positioned on top of the lower sheet of the bed (or beneath), just as for a conventional featherbed. The user will then lie on the down-topper element, with the upper sheet and the blankets covering the user. When the topper 12 becomes soiled in use, the attaching elements 20 are simply disconnected and the down-topper is removed and washed in a conventional washing machine. The featherbed itself thus remains unsoiled, and the difficulty in cleaning the featherbed is accordingly remedied. The down-topper constructed as set forth above can be regularly and repeatedly washed in conventional washing machines without in any way damaging the characteristics of the down-topper.

The combination of the down-topper element and the featherbed has additional advantages as well. The product is natural (a cotton tick with a down filling), durable and provides significant protection for the featherbed. The topper adds additional cushioning and comfort to a conventional featherbed, and permits, if desired, a less full or thinner, and hence less expensive, featherbed. Still further, it provides some protection against feathers coming through the tick of the featherbed.

Although a preferred embodiment of the invention has been disclosed herein for illustration, it should be understood that various changes, modifications and substitutions may be incorporated in such embodiment without departing from the spirit of the invention, which is defined by the claims which follow.

What is claimed is:

1. A featherbed and topper combination, comprising:

a conventional featherbed member having upper and lower surfaces, the featherbed member being separate from and adapted and arranged to lie on top of a conventional bed mattress, wherein the featherbed member has an interior fill weight of approximately 5 to 17 pounds and is otherwise generally not suitable as a conventional bed mattress;

a thin top member comprising a tick with a light filling therein, having an outline substantially identical to the outline of the featherbed, wherein the top member is readily washable; and means for removably securing the top member to the upper surface of the featherbed.

2. An article of claim 1, wherein the top member is filled with down.

3. An article of claim 1, wherein the top member has a fill which is less than a lightly filled conventional down comforter.

4. An article of claim 1, wherein said removably securing means includes straps which maintain the top member in position on the featherbed member.

5. An article of claim 4, wherein said straps extend from one of the members to a mating element on the other member.

6. An article of claim 1, wherein said removable securing means includes a cover member, which encases the featherbed member and the top member, tending to maintain the two members in relative position to each other on the conventional mattress.

7. An article of claim 1, wherein the tick is filled with at least six ounces of filling.

* * * * *